US011427002B2

(12) United States Patent
Miyasaka

(10) Patent No.: US 11,427,002 B2
(45) Date of Patent: Aug. 30, 2022

(54) LIQUID ABSORBING STRUCTURE AND LIQUID DROPLET EJECTING APPARATUS

(71) Applicant: SEIKO EPSON CORPORATION, Tokyo (JP)

(72) Inventor: Yoichi Miyasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/042,234

(22) PCT Filed: Feb. 6, 2019

(86) PCT No.: PCT/JP2019/004126
§ 371 (c)(1),
(2) Date: Sep. 28, 2020

(87) PCT Pub. No.: WO2019/187656
PCT Pub. Date: Oct. 3, 2019

(65) Prior Publication Data

US 2021/0031526 A1 Feb. 4, 2021

(30) Foreign Application Priority Data

Mar. 29, 2018 (JP) ..... JP2018-066253

(51) Int. Cl.
*B41J 2/165* (2006.01)
*B41J 2/17* (2006.01)

(52) U.S. Cl.
CPC ..... *B41J 2/16517* (2013.01); *B41J 2/1721* (2013.01)

(58) Field of Classification Search
CPC ..... B41J 2/1721; B41J 2/16523; B41J 2002/1728; D04H 1/407
See application file for complete search history.

(56) References Cited

U.S. PATENT DOCUMENTS

| | | | | |
|---|---|---|---|---|
| 2014/0184692 | A1 | 7/2014 | Takano et al. | |
| 2014/0184694 | A1 | 7/2014 | Takano et al. | |
| 2019/0232677 | A1* | 8/2019 | Aoki | B41J 2/17509 |

FOREIGN PATENT DOCUMENTS

| | | | | |
|---|---|---|---|---|
| EP | 3686016 | A1 | | 7/2020 |
| JP | H08-112911 | A | | 5/1996 |
| JP | 2006-035589 | A | | 2/2006 |
| JP | 2007-055195 | A | | 3/2007 |
| JP | 2008-006634 | A | | 1/2008 |
| JP | 2009-274302 | A | | 11/2009 |
| TW | 201941827 | A | * | 3/2019 |
| WO | 2018/008758 | A1 | | 1/2018 |

* cited by examiner

*Primary Examiner* — Sharon Polk
(74) *Attorney, Agent, or Firm* — Global IP Counselors, LLP

(57) ABSTRACT

The liquid absorbing structure includes: a liquid absorber having a fiber and a water-absorbent resin capable of absorbing liquid; and a container having a supply port through which the liquid is supplied and a storage space in which the liquid absorber is stored. The liquid absorber contains a first liquid absorber and a second liquid absorber that are different in density of at least one of the fiber and the water-absorbent resin. The first liquid absorber and the second liquid absorber are disposed at different positions in the container.

12 Claims, 7 Drawing Sheets

LIQUID ABSORBING STRUCTURE AND LIQUID DROPLET EJECTING APPARATUS

CROSS-REFERENCE TO RELATED APPLICATIONS

This application is a U.S. National stage application of International Patent Application No. PCT/JP2019/004126, filed on Feb. 6, 2019, which claims priority to Japanese Patent Application No. 2018-066253, filed in Japan on Mar. 29, 2018. The entire disclosure of Japanese Patent Application No. 2018-066253 is hereby incorporated herein by reference.

TECHNICAL FIELD

The present invention relates to a liquid absorbing structure and a liquid droplet ejecting apparatus.

BACKGROUND ART

For example, ink jet printers normally generate waste ink during head cleaning for preventing decreases in print quality caused by ink clogging or during ink charging after ink cartridge exchange. To avoid undesired accumulation of such waste ink in the printer internal system or the like, ink jet printers include a liquid absorber (ink absorber) for absorbing waste ink.

In the related art, a liquid absorber (ink absorber) contains a natural cellulose fiber and/or a synthetic fiber and a heat-fusible substance (see, for example, Japanese Patent No. 3536870).

SUMMARY

However, such a known liquid absorber (ink absorber) has low ink permeability so that it fails to absorb a sufficient amount of waste ink or fails to rapidly absorb waste ink.

The present invention is directed to a liquid absorbing structure and a liquid droplet ejecting apparatus that have improved ink absorption properties.

The present invention is made to solve at least some of the above-described problems and accomplished as described below.

A liquid absorbing structure according to the present invention includes:

a liquid absorber having a fiber and a water-absorbent resin capable of absorbing liquid; and a container having a supply port through which the liquid is supplied and a storage space in which the liquid absorber is stored.

The liquid absorber contains a first liquid absorber and a second liquid absorber that are different in density of at least one of the fiber and the water-absorbent resin.

The first liquid absorber and the second liquid absorber are disposed at different positions in the container.

A liquid droplet ejecting apparatus according to the present invention includes a collecting unit that collects waste ink.

The liquid absorbing structure according to the present invention is installed in the collecting unit.

DESCRIPTION OF EMBODIMENTS

A liquid absorbing structure and a liquid droplet ejecting apparatus according to the present invention will be specifically described below on the basis of preferred embodiments shown in the appended drawings.

First Embodiment

Figure 1:
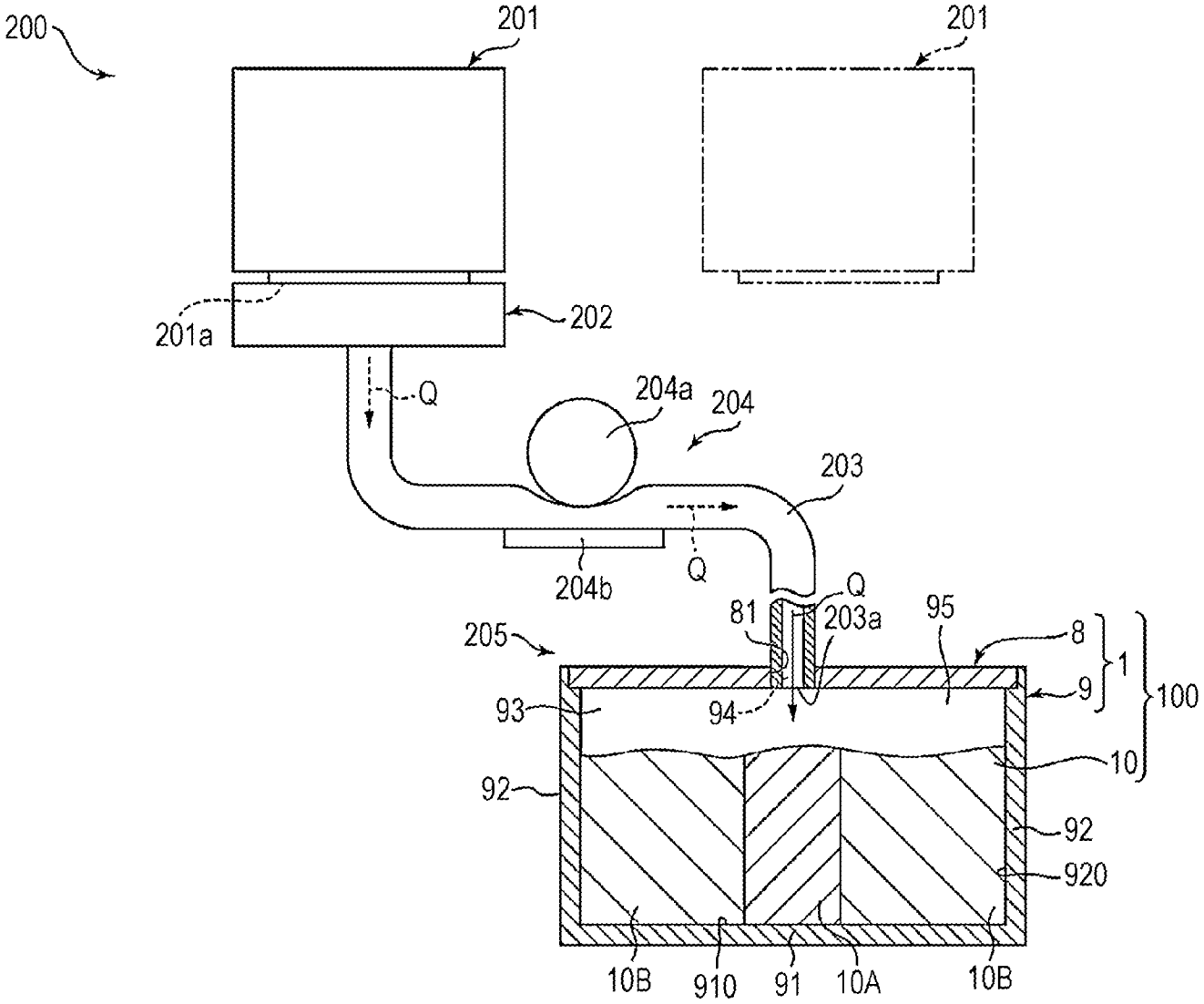
FIG. 1 is a partial vertical cross-sectional view that illustrates a sequence of operating states (example) of a first embodiment of a liquid absorbing structure according to the present invention.
Figure 2:
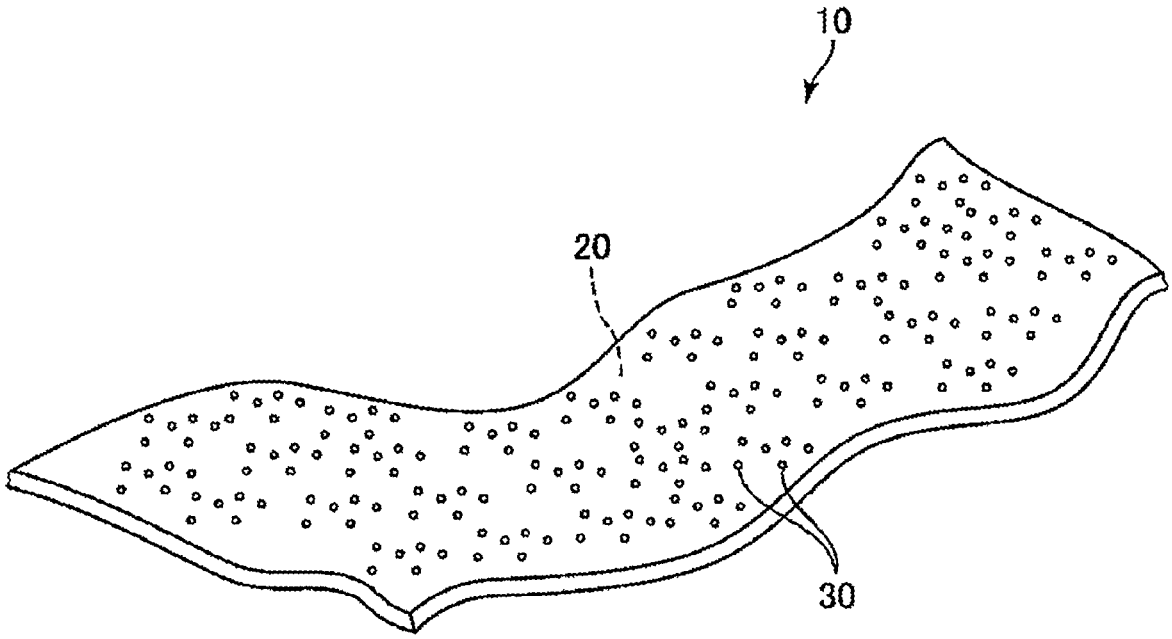
FIG. 2 is an enlarged view that illustrates an example form (small piece) of the liquid absorber shown in FIG. 1.
Figure 3:
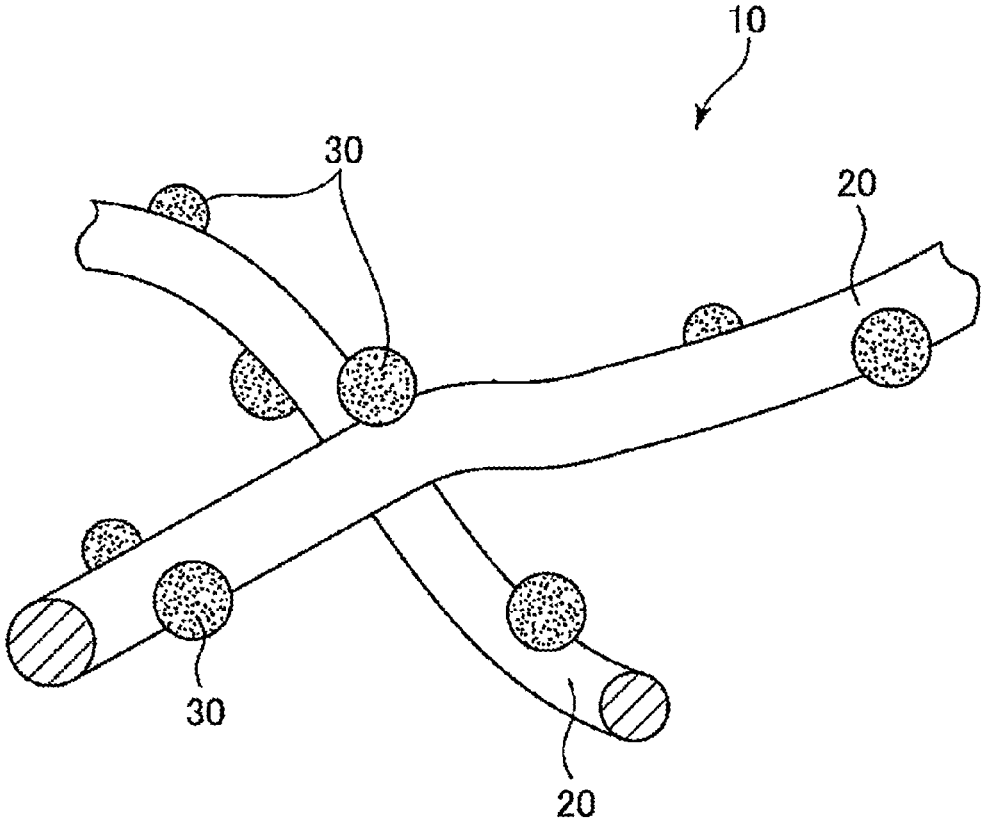
FIG. 3 is an enlarged view that illustrates an example form (fibrillated fiber) of the liquid absorber shown in FIG. 1.
Figure 4:
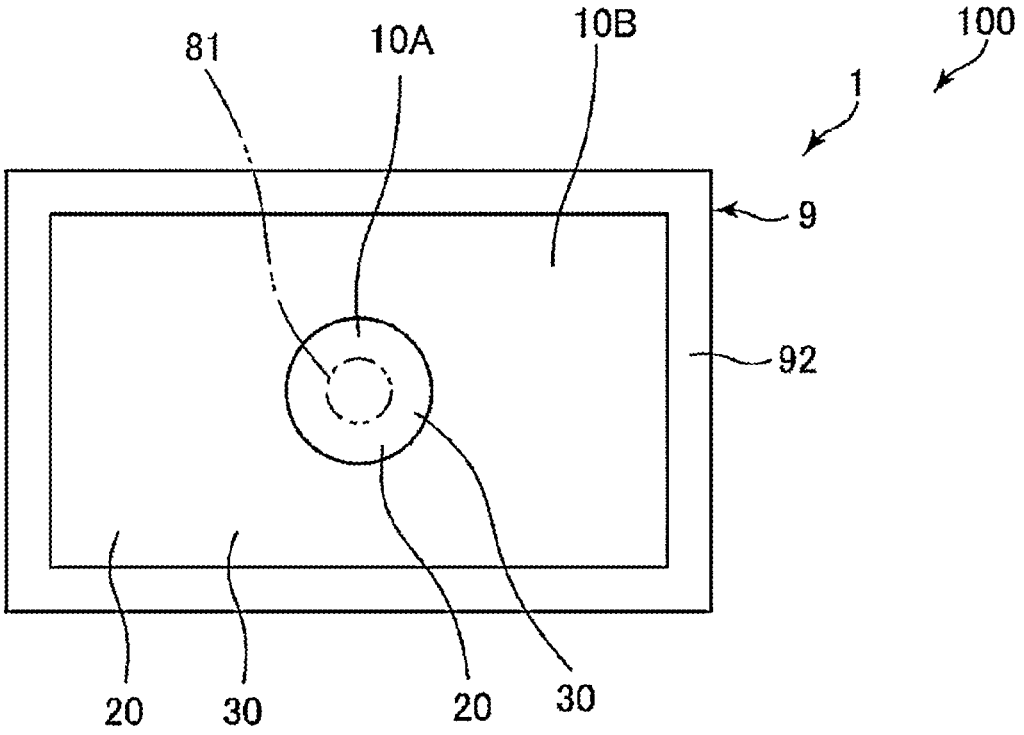
FIG. 4 is a view of the inside of the liquid absorber storage container of the liquid absorbing structure shown in FIG. 1 as seen from the supply port.
Figure 5:
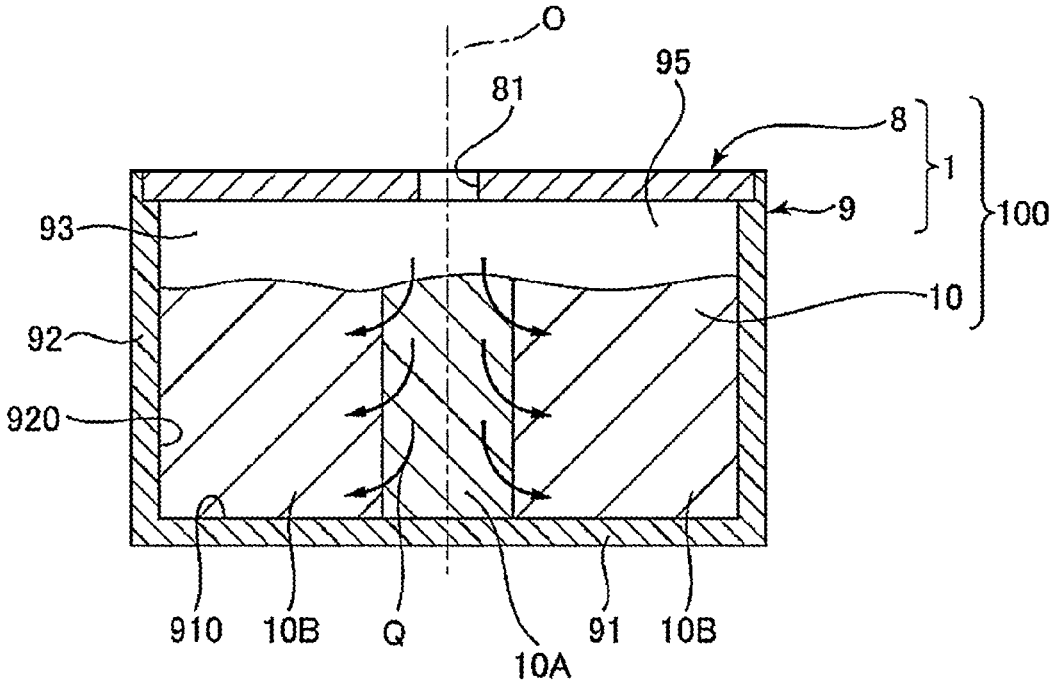
FIG. 5 is a partial vertical cross-sectional view of the liquid absorbing structure shown in FIG. 4.

FIG. 1 is a partial vertical cross-sectional view that illustrates a sequence of operating states (example) of a first embodiment of the liquid absorbing structure according to the present invention. FIG. 2 is an enlarged view that illustrates an example form (small piece) of the liquid absorber shown in FIG. 1. FIG. 3 is an enlarged view that illustrates an example form (fibrillated fiber) of the liquid absorber shown in FIG. 1. FIG. 4 is a view of the inside of the liquid absorber storage container of the liquid absorbing structure shown in FIG. 1 as seen from the supply port. FIG. 5 is a partial vertical cross-sectional view of the liquid absorbing structure shown in FIG. 4.

Hereinafter, the upper side and the lower side in FIG. 1 and FIG. 5 (the same applies to FIG. 6 to FIG. 8, FIG. 10, and FIG. 11) are respectively referred to as "upper (or above)" and "lower (or below)" for convenience of description.

As illustrated in FIG. 1, a liquid absorbing structure 100 according to the present invention includes: an ink absorber 10 (liquid absorber) having a fiber 20 and a water-absorbent resin 30 capable of absorbing ink Q (liquid); and an ink absorber storage container 1 (container) having an ink supply port 81 (supply port) through which the ink Q (liquid) is supplied and a storage space 93 in which the ink absorber 10 (liquid absorber) is stored. The ink absorber 10 (liquid absorber) contains a first ink absorber 10A (first liquid absorber) and a second ink absorber 10B (second liquid absorber) which are different in density of at least one of the fiber 20 and the water-absorbent resin 30. The first ink absorber 10A (first liquid absorber) and the second ink absorber 10B (second liquid absorber) are disposed at different positions in the ink absorber storage container 1.

The first ink absorber 10A and the second ink absorber 10B can be thus disposed in the ink absorber storage container 1 according to their ink Q absorption properties. For example, the first ink absorber 10A in which the density of the fiber 20 is low has high permeability (diffusivity), whereas the second ink absorber 10B in which the density of the water-absorbent resin 30 is low exhibits high water absorbency (water retention). In the present invention, according to these properties, for example, the first ink absorber 10A having high permeability can be disposed at a position (proximal to the ink supply port 81) such that the ink Q first comes into contact with the first ink absorber 10A, and the second ink absorber 10B exhibiting high water absorbency (water retention) can be disposed around the first ink absorber 10A (distal to the ink supply port 81). According to this configuration, the ink Q supplied into the ink absorber storage container 1 first rapidly permeates the entire first ink absorber 10A and is then effectively absorbed into the second ink absorber 10B. The present invention accordingly enables rapid and effective liquid absorption, that is, can improve the ink Q absorption properties.

The term "water absorption" as used herein refers to absorption of a water-based ink in which a color material is dissolved in an aqueous solvent, a solvent-based ink in which a binder is dissolved in a solvent, a UV-curable ink in which a binder is dissolved in a liquid monomer curable by UV irradiation, an ink such as latex ink in which a binder is dispersed in a dispersion medium, and other liquids (e.g., excreta, industrial waste liquid).

A printing apparatus 200 (liquid droplet ejecting apparatus) illustrated in FIG. 1 is, for example, an ink jet color printer. The printing apparatus 200 includes an ink ejecting head 201 which ejects the ink Q, a capping unit 202 which prevents clogging of a nozzle 201*a* of the ink ejecting head 201, a tube 203 which connects the capping unit 202 and the liquid absorbing structure 100, a roller pump 204 which feeds the ink Q from the capping unit 202 to the liquid absorbing structure 100, and a collecting unit 205.

The ink ejecting head 201 has multiple nozzles 201*a* from which the ink Q is ejected downward. The ink ejecting head 201 ejects the ink Q while moving relative to a recording medium (not illustrated), such as a PPC sheet, whereby printing is performed (see the ink ejecting head 201 drawn with long dashed double-dotted lines in FIG. 1).

The capping unit 202 collectively sucks the nozzles 201*a* by means of the operation of the roller pump 204 when the ink ejecting head 201 is in the standby position. This prevents clogging of the nozzles 201*a*.

The tube 203 is such that the ink Q sucked via the capping unit 202 passes through the tube 203 toward the liquid absorbing structure 100. The tube 203 has flexibility.

The roller pump 204 is disposed in the middle of the tube 203 and includes a roller unit 204*a* and a holding unit 204*b* which holds the middle of the tube 203 between the holding unit 204*b* and the roller unit 204*a*. As the roller unit 204*a* rotates, a suction force is generated in the capping unit 202 via the tube 203. As the roller unit 204*a* continuously rotates, the ink Q attached to the nozzle 201*a* can be fed to the collecting unit 205.

The liquid droplet ejecting apparatus (printing apparatus 200) according to the present invention includes the collecting unit 205 which collects waste ink Q, and the liquid absorbing structure 100 is installed in the collecting unit 205. The ink Q is absorbed into the liquid absorbing structure 100 as waste liquid. The ink Q includes various colors of ink. According to this configuration, the liquid absorbing structure 100 can absorb the ink Q while enjoying the advantages described above.

As illustrated in FIG. 1, the liquid absorbing structure 100 includes the ink absorber storage container 1 and the ink absorber 10 used to absorb the ink Q. The liquid absorbing structure 100 is detachably attached to the printing apparatus 200 and used to absorb waste ink Q as described above while being detachably attached to the printing apparatus 200. The liquid absorbing structure 100 can thus be used as a so-called "waste liquid tank (waste ink tank)". When the amount of the ink Q absorbed into the liquid absorbing structure 100 reaches the limit, the liquid absorbing structure 100 can be replaced by a new (unused) liquid absorbing structure 100. Whether the amount of the ink Q absorbed into the liquid absorbing structure 100 reaches the limit is detected by a detector (not illustrated) in the printing apparatus 200. When the amount of the ink Q absorbed into the liquid absorbing structure 100 reaches the limit, the notice is given by, for example, a notification unit (not illustrated) such as a monitor installed in the printing apparatus 200.

The ink absorber 10 (liquid absorber) is used to absorb the ink Q in the ink absorber storage container 1. As illustrated in FIG. 2 and FIG. 3, the ink absorber 10 includes the fiber 20 and the water-absorbent resin 30 attached to (carried on) the fiber 20. It is noted that strands of the fiber 20 are preferably bonded to each other via a binder (not illustrated).

When the ink Q is applied to the ink absorber 10, the fiber 20 once holds the ink Q and then can efficiently feed the ink Q to the water-absorbent resin 30, which can improve the ink Q absorption properties of the entire ink absorber 10. In general, fiber (particularly fiber from used paper) such as cellulose fiber is cheaper than the water-absorbent resin 30 and advantageous in low costs for manufacturing the ink absorber 10. Fiber from used paper is suitably used as the fiber 20, which is advantageous in, for example, reduction of waste and effective use of resources.

Examples of the fiber 20 include synthetic resin fibers, such as polyester fibers and polyamide fibers; natural resin fibers, such as cellulose fibers, keratin fibers, and fibroin fibers; and chemically modified fibers thereof. These fibers can be used alone or in a mixture as desired. The fiber 20 is preferably composed mainly of cellulose fiber and more preferably composed substantially entirely of cellulose fiber.

Since cellulose is a material having suitable hydrophilicity, the ink Q applied to the ink absorber 10 can readily get out of the particularly high fluidity state (e.g., the state of having a viscosity of 10 mPa·s or lower), and the once incorporated ink Q can be successfully fed to the water-absorbent resin 30 (can permeate the water-absorbent resin 30). As a result, the entire ink absorber 10 exhibits particularly high ink Q permeability (absorption properties). Since cellulose is normally highly compatible with the water-absorbent resin 30, the water-absorbent resin 30 can be successfully carried on the surface of the fiber 20. Cellulose fiber is a renewable natural material and cheap and easily available among various fibers. Cellulose fiber is thus advantageous in, for example, low production costs and stable production of the ink absorber 10, and low environmental burden.

The term cellulose fiber as used herein refers to any fibrous material composed mainly of cellulose (cellulose in a narrow sense) as a compound and includes, in addition to cellulose (cellulose in a narrow sense), hemicellulose and lignin.

The fiber 20 in the ink absorber 10 is in the form of small piece (see FIG. 2) in the following description, but the fiber 20 may be, for example, in a cottony form (see FIG. 3) or in a sheet form.

The entire length (the length in the longitudinal direction) of the small piece is, for example, preferably 0.5 mm or more and 500 mm or less, more preferably 1 mm or more and 100 mm or less, and still more preferably 2 mm or more and 30 mm or less, although the entire length depends on the shape and size of the ink absorber storage container 1 (see FIG. 2).

The width (the length in the transverse direction) of the small piece is, for example, preferably 0.1 mm or more and 100 mm or less, more preferably 0.3 mm or more and 50 mm or less, and still more preferably 1 mm or more and 20 mm or less, although the width depends on the shape and size of the ink absorber storage container 1 (see FIG. 2).

The aspect ratio of the entire length to the width is preferably 1.0 or more and 200 or less, and more preferably 1.0 or more and 30 or less. The thickness of the small piece is, for example, preferably 0.05 m or more and 2 mm or less, and more preferably 0.1 mm or more and 1 mm or less (see FIG. 2).

For example, used paper may be used as a raw material of the fiber 20. The use of used paper is preferred in view of the advantageous effects as described above and conservation of resources. When used paper is used as a raw material of the fiber 20, the used paper may be used without any processing, or shredded paper obtained by shredding used paper or fibrillated fiber obtained by fibrillating used paper may be used. For example, a sheet-shaped fiber base material 30 cm in length, 22 cm in width, and 0.1 mm in thickness can be used as used paper.

The average length of the fiber 20 is preferably, but not necessarily, 0.1 mm or more and 5 mm or less, and more preferably 0.2 mm or more and 3 mm or less. The average width (diameter) of the fiber 20 is preferably, but not necessarily, 0.5 μm or more and 200 μm or less, and more preferably 1.0 μm or more and 100 μm or less. The average aspect ratio (the ratio of the average length to the average width) of the fiber 20 is preferably, but not necessarily, 10 or more and 1000 or less, and more preferably 15 or more and 500 or less.

Having the average aspect ratio in such a range, the fiber 20 can successfully carry the water-absorbent resin 30, hold the ink Q, and feed the ink Q to the water-absorbent resin 30. As a result, the entire ink absorber 10 exhibits high ink Q permeability (absorption properties).

The water-absorbent resin 30 is any resin having water absorbency. Examples of the water-absorbent resin include, but are not limited to, carboxymethyl cellulose, polyacrylic acid, polyacrylamide, starch-acrylic acid graft copolymer, hydrolyzed starch-acrylonitrile graft copolymer, vinyl acetate-acrylic acid ester copolymer, isobutylene-maleic acid copolymer, hydrolyzed acrylonitrile copolymers or acrylamide copolymers, polyethylene oxide, polysulfonic acid compounds, polyglutamic acid, salts (neutralized products) thereof, and cross-linked products. The term water absorbency refers to a function of having hydrophilicity and retaining water. Many of the water-absorbent resin 30 are gelled when absorbing water.

In particular, the water-absorbent resin 30 is preferably a resin having a functional group in its side chain. Examples of the functional group include an acid group, a hydroxyl group, an epoxy group, and an amino group.

In particular, the water-absorbent resin 30 is preferably a resin having an acid group in its side chain, and more preferably a resin having a carboxyl group in its side chain.

Examples of the carboxyl group-containing unit that constitutes the water-absorbent resin 30 include units derived from monomers, such as acrylic acid, methacrylic acid, itaconic acid, maleic acid, crotonic acid, fumaric acid, sorbic acid, cinnamic acid, anhydrides thereof, and salts thereof.

When the water-absorbent resin 30 having acid groups in side chains is present, the proportion of acid groups neutralized to form salts among the acid groups contained in the water-absorbent resin 30 is preferably 30 mol % or more and 100 mol % or less, more preferably 50 mol % or more and 95 mol % or less, still more preferably 60 mol % or more and 90 mol % or less, and yet still more preferably 70 mol % or more and 80 mol % or less. At such a proportion, the water-absorbent resin 30 (ink absorber 10) has high ink Q absorbency (water retention).

Examples of the neutralized salt include, but are not limited to, alkali metal salts, such as sodium salts, potassium salts, and lithium salts; and salts of nitrogen-containing basic substances, such as ammonia. The neutralized salt is preferably a sodium salt. With such a salt, the water-absorbent resin 30 (ink absorber 10) has high ink Q absorbency (water retention).

The water-absorbent resin 30 having acid groups in side chains is preferred because electrostatic repulsion between acid groups occurs during ink absorption to accelerate the absorption rate. When the acid groups are neutralized, the ink Q tends to be absorbed into the water-absorbent resin 30 due to osmotic pressure.

The water-absorbent resin 30 may have a structural unit with no acid group. Examples of such a structural unit include hydrophilic structural units, hydrophobic structural units, structural units that serve as polymerization cross-linkers.

Examples of the hydrophilic structural units include structural units derived from nonionic compounds, such as acrylamide, methacrylamide, N-ethyl(meth)acrylamide, N-n-propyl(meth)acrylamide, N-isopropyl(meth)acrylamide, N,N-dimethyl(meth)acrylamide, 2-hydroxyethyl(meth) acrylate, 2-hydroxypropyl(meth)acrylate, methoxy polyethylene glycol (meth)acrylate, polyethylene glycol mono (meth)acrylate, N-vinylpyrrolidone, N-acryloylpiperidine, and N-acryloylpyrrolidine.

Examples of the hydrophobic structural units include structural units derived from compounds, such as (meth) acrylonitrile, styrene, vinyl chloride, butadiene, isobutene, ethylene, propylene, stearyl (meth)acrylate, and lauryl (meth) acrylate.

Examples of the structural units that serve as polymerization cross-linkers include structural units derived from diethylene glycol diacrylate, N,N'-methylenebisacrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylate, isocyanuric acid diacrylate, tetraallyloxyethane, diallyloxyacetate, and the like.

The water-absorbent resin 30 preferably contains a polyacrylic acid salt copolymer or a polyacrylic acid polymerized/cross-linked product. This provides, for example, advantages, such as high ink Q absorbency (water retention) and low manufacturing costs.

In the polyacrylic acid polymerized/cross-linked product, the proportion of carboxyl group-containing structural units in all structural units that constitute molecular chains is preferably 50 mol % or higher, more preferably 80 mol % or higher, and still more preferably 90 mol % or higher.

If the proportion of carboxyl group-containing structural units is too low, it may be difficult to sufficiently improve the ink Q absorption performance.

The carboxyl groups in the polyacrylic acid polymerized/cross-linked product are preferably partially neutralized (subjected to partial neutralization) to form salts.

The proportion of neutralized carboxyl groups in all carboxyl groups in the polyacrylic acid polymerized/cross-linked product is preferably 30 mol % or more and 99 mol % or less, more preferably 50 mol % or more and 99 mol % or less, and still more preferably 70 mol % or more and 99 mol % or less.

The water-absorbent resin 30 may have a structure formed by cross-linking using a cross-linker other than the above-described polymerization cross-linkers.

When the water-absorbent resin 30 is a resin having an acid group, the cross-linker is preferably, for example, a compound having multiple functional groups reactive with the acid group.

When the water-absorbent resin 30 is a resin having a functional group reactive with an acid group, the cross-linker is preferably a compound having, in the molecule, multiple functional groups reactive with the acid group.

Examples of the compound (cross-linker) having multiple functional groups reactive with the acid group include glycidyl ether compounds, such as ethylene glycol diglycidyl ether, trimethylolpropane triglycidyl ether, (poly)glycerol polyglycidyl ether, diglycerol polyglycidyl ether, and propylene glycol diglycidyl ether; polyhydric alcohols, such as (poly)glycerol, (poly)ethylene glycol, propylene glycol, 1,3-propanediol, polyoxyethylene glycol, triethylene glycol, tetraethylene glycol, diethanolamine, and triethanolamine; and polyvalent amines, such as ethylenediamine, diethylenediamine, polyethyleneimine, and hexamethylenediamine. In addition, for example, multivalent ions, such as zinc, calcium, magnesium, and aluminum, can also be preferably used because they react with the acid group of the water-absorbent resin 30 so as to function as a cross-linker.

The water-absorbent resin 30 may be in any form, such as a scale form, a needle form, a fiber form, or a particle form, but preferably in a particle form. When the water-absorbent resin 30 is in a particle form, it is easy to ensure ink Q permeability. In addition, the water-absorbent resin 30 can be successfully carried on the fiber 20. The average particle size of the particles is preferably 50 μm or more and 800 μm or less, more preferably 100 μm or more and 600 μm or less, and still more preferably 200 μm or more and 500 μm or less.

The ink absorber 10 may contain components (other components) other than the above-described components. Examples of such components include surfactants, lubricants, defoamers, fillers, anti-blocking agents, ultraviolet absorbers, coloring agents such as pigments and dyes, flame retardants, and fluidity improvers.

As illustrated in FIG. 1, the ink absorber storage container 1 includes a container body 9 having the storage space 93 in which the ink absorber 10 is stored, and a lid body 8 detachably attached to the container body 9.

The container body 9 has a box shape having a bottom (bottom plate) 91 with, for example, a rectangular shape in plan view, and four side walls 92 standing upward from the respective sides (edges) of the bottom 91. The ink absorber 10 can be stored in the storage space 93 surrounded by the bottom 91 and the four side walls 92. Hereinafter, a face of the bottom 91 that faces the storage space 93 is referred to as a bottom face 910, and faces of the side walls 92 that face the storage space 93 are referred to as inner side faces 920. The bottom face 910 and the inner side faces 920 define the storage space 93.

The container body 9 is not limited to a container body having the bottom 91 with a rectangular shape in plan view, and may be, for example, a cylindrical container body having a bottom 91 with a circular shape in plan view.

The ratio V2/V1 of V2 to V1 where V1 represents the volume of the container body 9 (storage space 93) and V2 represents the total volume of the ink absorber 10 before absorption of the ink Q (before water absorption) is preferably 0.1 or more and 0.7 or less, and more preferably 0.2 or more and 0.7 or less (see FIG. 1). At such a ratio, a void 95 is generated above the ink absorber 10 in the container body 9. The ink absorber 10 once expands (swells) after absorbing the ink Q. The void 95 functions as a buffer when the ink absorber 10 expands, and the ink absorber 10 can thus absorb the ink Q well.

In this embodiment, the container body 9 is hard, that is, has shape retention to such an extent that the volume V1 does not change by, for example, 10% or more when the container body 9 experiences an internal pressure or external force. Having this property, the container body 9 can maintain its shape even when the ink absorber 10 expands after absorbing the ink Q and the container body 9 experiences an internal force from the ink absorber 10. This configuration stabilizes the installation condition of the container body 9 in the printing apparatus 200 and allows the ink absorber 10 to stably absorb the ink Q.

The container body 9 is made of any material that the ink Q does not permeate. Examples of such a material of the container body 9 include various resin materials, such as cyclic polyolefins and polycarbonates. Examples of the material of the container body 9 include, in addition to the above-described various resin materials, various metal materials, such as aluminum and stainless steel.

The container body 9 is not necessarily hard and may be flexible (soft), that is, such that the volume V1 changes by, for example, 10% or more when the container body 9 experiences an internal pressure or external force.

The container body 9 may be either transparent (including semi-transparent) so as to have internal visibility or may be opaque. Preferably, the container body 9 and the lid body 8 described below at least partially have internal visibility.

As described above, the liquid absorbing structure 100 includes the lid body 8. As illustrate in FIG. 1, the lid body 8 has a plate shape and can be fitted into an upper opening 94 of the container body 9. This fitting can seal the upper opening 94 in a liquid tight manner. This configuration can prevent the ink Q from spreading outside, for example, even if the ink Q discharged and dropping from the tube 203 strikes the ink absorber 10 and bounces up. Therefore, the ink Q can be prevented from adhering to and staining the surroundings of the liquid absorbing structure 100.

The tube 203 is connected to a central portion of the lid body 8 to form an ink supply port (connection port) 81 through which the ink Q is supplied into the storage space 93. The ink supply port 81 is composed of a through-hole that passes through the lid body 8 in the thickness direction. The tube 203 can be connected to the lid body 8 such that a downstream end (lower end) of the tube 203 is inserted into the ink supply port 81 (through-hole). At this time, a discharge port (opening) 203*a* of the tube 203 faces downward. The ink supply port 81 may be formed at a position distant from a central portion of the lid body 8.

The lid body 8 may have ink absorbency to absorb the ink Q or may have liquid repellency to repel the ink Q.

The thickness of the lid body 8 is preferably, but not necessarily, for example, 1 mm or more and 20 mm or less, and more preferably 8 mm or more and 10 mm or less. The lid body 8 is not limited to a plate-shaped lid body having a thickness in this range, and may be a film-shaped (sheet-shaped) lid body thinner than this thickness. In this case, the thickness of the lid body 8 is preferably, but not necessarily, for example, 10 μm or more and less than 1 mm.

The lid body 8 preferably has water vapor permeability. With the lid body 8 having this property, water evaporated from the absorbed ink Q can permeate the lid body 8 to the outside. This can increase the amount of the ink Q that can be absorbed by the ink absorber 10.

The water vapor transmission rate of the lid body 8 is preferably 1.0 $g/m^2$/day (40° C., 90% RH) or higher and 5000 $g/m^2$/day (40° C., 90% RH) or lower, and more preferably 2.0 $g/m^2$/day (40° C., 90% RH) or higher and 2000 $g/m^2$/day (40° C., 90% RH) or lower. At such a rate, the above-described advantageous effect can be obtained more assuredly.

The materials of the container body 9 and the lid body 8 are not limited and, for example, various resin materials can be suitably used. Examples of the resin materials include various thermoplastic resins, and various curable resins, such as thermosetting resins and photocurable resins. Specific examples include polyolefins, such as polyethylene, polypropylene, and ethylene-propylene copolymer; polyesters, such as polyvinyl chloride, polystyrene, polyamide, polyimide, polycarbonate, poly-(4-methylpentene-1), ionomer, acrylic resin, polymethyl methacrylate, acrylonitrile-butadiene-styrene copolymer (ABS resin), acrylonitrile-styrene copolymer (AS resin), butadiene-styrene copolymer, polyethylene terephthalate (PET), and polybutylene terephthalate (PBT); polyether, polyether ketone (PEK), polyether ether ketone (PEEK), polyetherimide, polyacetal (POM), polyphenylene oxide, polysulfone, polyether sulfone, polyphenylene sulfide, polyarylate, aromatic polyester (liquid crystal polymer), polytetrafluoroethylene, polyvinylidene difluoride, other fluorocarbon resins, epoxy resin, phenol resin, urea resin, melamine resin, silicone resin, and polyurethane; copolymers, blends, polymer alloys, and the like containing these as main components. These resin materials can be used alone or in combination of two or more.

The first ink absorber 10A is disposed at a position such that the ink Q (liquid) supplied through the ink supply port 81 first comes into contact with the first ink absorber 10A, and the second ink absorber 10B is disposed at a position such that the ink Q comes into contact with the second ink absorber 10B after contact with the first ink absorber 10A.

Specifically, as illustrated in FIG. 4, the first ink absorber 10A is disposed at a position so as to overlap the ink supply port 81, that is, directly under the ink supply port 81, as seen from the ink supply port 81 (in plan view). The first ink absorber 10A has a larger size than the opening of the ink supply port 81 as seen from the ink supply port 81, and the first ink absorber 10A is large enough to encompass the ink supply port 81. Thus, the ink Q dropped from the ink supply port 81 can first come into contact with the first ink absorber 10A more assuredly.

In the structure illustrated in the figure, the first ink absorber 10A has a circular shape as seen from the ink supply port 81. The first ink absorber 10A is not limited to a circular shape, and may have a shape, such as an elliptical shape, a rectangular shape, a polygonal shape, or a star shape.

As illustrated in FIG. 5, the first ink absorber 10A is disposed so as to extend along a central axis O of the ink supply port 81 as seen in the cross-section taken along the central axis O. The first ink absorber 10A is disposed in contact with the bottom 91.

In other words, the ink absorber storage container 1 (container) has the bottom face 910 and the inner side faces 920 which define the storage space 93, and the first ink absorber 10A (first liquid absorber) is in contact with the bottom face 910 of the ink absorber storage container 1 (container). According to this configuration, the ink supplied to the ink absorber storage container 1 can readily permeate to the bottom face of the ink absorber storage container 1, as described below.

The second ink absorber 10B is disposed around the first ink absorber 10A and disposed in contact with the side walls 92 as illustrated in FIG. 4 and in contact with the bottom 91 as illustrated in FIG. 5.

In plan view as seen from the ink supply port 81 (supply port), the first ink absorber 10A (first liquid absorber) is thus disposed at a position so as to overlap the ink supply port 81 (supply port), and the second ink absorber 10B (second liquid absorber) is disposed around the first ink absorber 10A (first liquid absorber). According to this configuration, the ink Q supplied into the ink absorber storage container 1 can first come into contact with the first liquid absorber. Therefore, liquid can be absorbed rapidly and effectively.

The second ink absorber 10B is not necessarily in contact with the side walls 92. In other words, a void may be formed between the second ink absorber 10B and the side walls 92. The void can thus function as a relief area when the second ink absorber 10B absorbs the ink Q and swells.

As described above, the first ink absorber 10A and the second ink absorber 10B disposed in this manner are different in density of at least one of the fiber 20 and the water-absorbent resin 30. As the density of the fiber 20 decreases, the ink Q permeability increases. As the density of the water-absorbent resin 30 decreases, the ink Q absorbency (water retention) increases. The first ink absorber 10A and the second ink absorber 10B are accordingly different in ink Q absorption properties.

In this embodiment, the density of the fiber 20 of the first ink absorber 10A (first liquid absorber) is lower than the density of the fiber 20 of the second ink absorber 10B. The ink Q can thus sufficiently ensure gaps between strands of the fiber 20 in the first ink absorber 10A, and the ink Q easily permeates the first ink absorber 10A. In other words, the first ink absorber 10A has higher ink Q permeability than the second ink absorber 10B.

The ratio A1/A2 where A1 represents the density of the fiber 20 in the first ink absorber 10A (first liquid absorber) and A2 represents the density of the fiber 20 in the second ink absorber 10B (second liquid absorber) is preferably 0.1 or more and 0.9 or less, and more preferably 0.2 or more and 0.8 or less. At such a ratio, the first ink absorber 10A has high permeability more assuredly.

If the ratio A1/A2 is too small, the density of the fiber 20 in the second ink absorber 10B is relatively high, and the permeability of the second ink absorber 10B tents to be low. If the ratio A1/A2 is too large, the advantageous effect from providing a difference in density of the fiber 20 is not obtained.

In this embodiment, the density of the water-absorbent resin 30 of the first ink absorber 10A (first liquid absorber) is lower than the density of the water-absorbent resin 30 of the second ink absorber 10B (second liquid absorber). The first ink absorber 10A thus exhibits lower expansion coefficient than the second ink absorber 10B when absorbing the ink Q. This prevents the expanded water-absorbent resin 30 from inhibiting permeation of the ink Q.

The ratio B1/B2 where B1 represents the density of the water-absorbent resin 30 in the first ink absorber 10A (first liquid absorber) and B2 represents the density of the water-absorbent resin 30 in the second ink absorber 10B (second liquid absorber) is preferably 0 or more and 0.9 or less, and more preferably 0.1 or more and 0.8 or less. At such a ratio, the above-described advantageous effect can be obtained more significantly.

If the ratio B1/B2 is too small, the amount of the water-absorbent resin 30 of the second ink absorber 10B tends to be too high, and the permeability of the second ink absorber 10B tents to be too low. If the ratio B1/B2 is too large, the permeability of the first ink absorber 10A tents to be low.

When at least one of the fiber 20 and the water-absorbent resin 30 is different, the advantageous effects of the present invention can be obtained. When the fiber 20 and the water-absorbent resin 30 are both different, the advantageous effects of the present invention are obtained more significantly due to synergistic effects.

Since the density of the fiber 20 of the second ink absorber 10B is larger than that of the first ink absorber 10A, relatively narrow gaps are formed between strands of the fiber 20 of the second ink absorber 10B, which can prevent the ink Q from having excessively high fluidity. The ink Q that has once permeated the second ink absorber 10B is thus unlikely to seep from the second ink absorber 10B.

In addition, since the density of the water-absorbent resin 30 of the second ink absorber 10B is larger than that of the first ink absorber 10A, the amount of the ink Q absorbed per unit volume of the ink Q is larger in the second ink absorber 10B. In combination of this and the foregoing, the second ink absorber 10B exhibits high water absorbency (moisture retention).

In this embodiment, as described above, the first ink absorber 10A having high permeability is disposed at a position such that the ink Q supplied through the ink supply port 81 first comes into contact with the first ink absorber 10A, and the supplied ink Q readily permeates in the direction of the central axis O and in the directions intersecting the central axis O as indicated by the arrows in FIG. 5. The ink Q transmits the first ink absorber 10A to the second ink absorber 10B having high water absorbency (moisture retention), whereby the ink Q is absorbed assuredly and prevented from seeping out (leaking out).

In the present invention, the positions at which the first ink absorber 10A and the second ink absorber 10B are disposed can be thus set according to the ink Q (liquid) absorption properties of the first ink absorber 10A and the second ink absorber 10B. As a result, for example, as described above, the ink Q can permeate the entire ink absorber, while the ink Q can be absorbed into the ink absorber assuredly and prevented from seeping out (leaking out).

When the fiber 20 of the first ink absorber 10A and the fiber 20 of the second ink absorber 10B are in the form of small piece as in this embodiment, a difference in density of the fiber 20 can be generated by providing a configuration in which the first ink absorber 10A and the second ink absorber 10B are the same in packing amount of the small piece but different in density of the fiber 20 of the small piece itself, a configuration in which the first ink absorber 10A and the second ink absorber 10B are the same in density of the fiber 20 of the small piece but different in packing amount of the small piece, or a configuration in which the first ink absorber 10A and the second ink absorber 10B are different in packing amount of the small piece and in density itself of the fiber 20 of the small piece.

It is noted that the first ink absorber 10A and the second ink absorber 10B may be different in form of the fiber 20. In other words, one of the fiber 20 of the first ink absorber 10A and the fiber 20 of the second ink absorber 10B may be a small piece, and the other may be in a cottony form. Even in this case, a difference in density of the fiber 20 can be generated between the first ink absorber 10A and the second ink absorber 10B.

A difference in density of the fiber 20 and a difference in density of the water-absorbent resin 30 can also be generated between the first ink absorber 10A and the second ink absorber 10B by providing a configuration in which the same small piece with the same amount of the water-absorbent resin 30 carried thereon, namely, the same ink absorber, is used but the compression amount (packing amount) of the ink absorber differs.

The first ink absorber 10A and the second ink absorber 10B may both be in a cottony form. In this case, a difference in density of the fiber 20 can be generated between the first ink absorber 10A and the second ink absorber 10B by providing a configuration in which the type of fiber 20 such as the average length or the thickness of the fiber 20 differs, or a configuration in which the bulk density of the same fiber differs.

A difference in density of the water-absorbent resin 30 can also be generated between the first ink absorber 10A and the second ink absorber 10B by providing a configuration in which the amount of the water-absorbent resin 30 of the same particle size (same type) carried on the fiber 20 differs, or a configuration in which the same number of particles of the water-absorbent resin 30 having different particle sizes (shapes) are carried on the fiber 20.

The present invention includes all combinations of the configurations in which the density of the fiber 20 differs and the configurations in which the density of the water-absorbent resin 30 differs, as described above. The forgoing advantageous effects can be obtained by providing only a difference in at least one of the density of the fiber 20 and the density of the water-absorbent resin 30.

Second Embodiment

Figure 6:
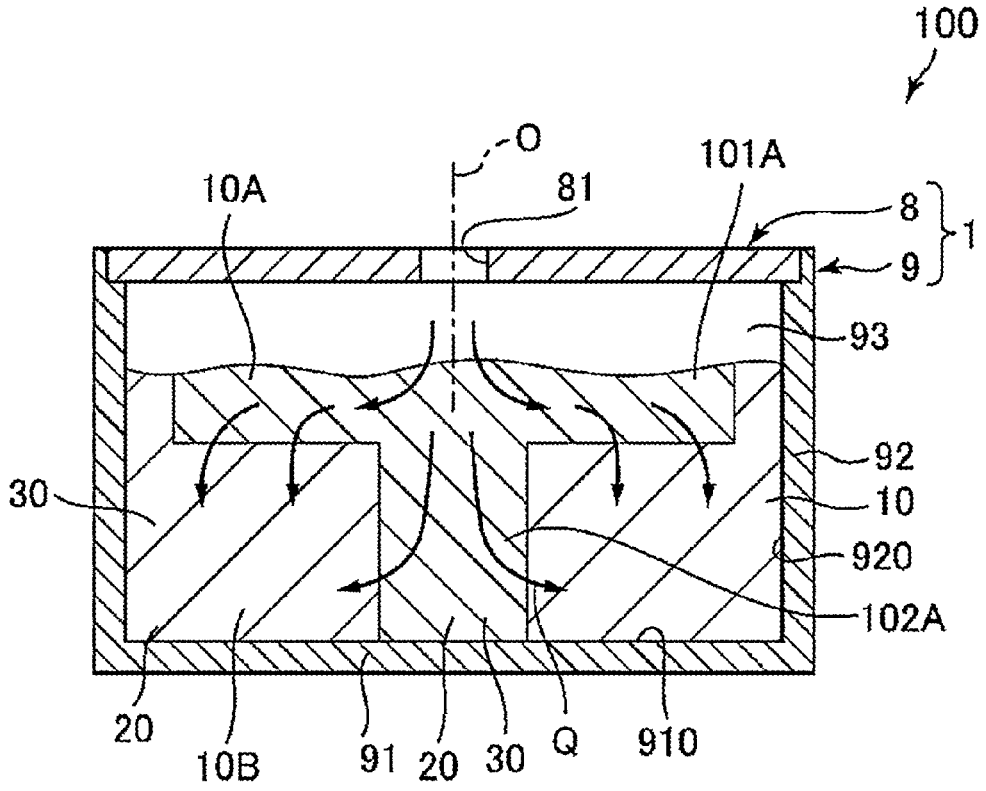
FIG. 6 is a partial vertical cross-sectional view of a second embodiment of the liquid absorbing structure according to the present invention.

FIG. 6 is a partial vertical cross-sectional view of a second embodiment of the liquid absorbing structure according to the present invention.

The second embodiment of the liquid absorbing structure according to the present invention will be described below with reference to this figure. The different points from the above-described embodiment will be mainly described, and the same points will not be described.

This embodiment is the same as the first embodiment except for the shapes of the regions where the first liquid absorber and the second liquid absorber are disposed.

In a liquid absorbing structure 100 according to this embodiment, as illustrated in FIG. 6, the region where a first ink absorber 10A is disposed has portions having different shapes in the direction of the central axis O of the ink supply port 81 as seen in the cross-section taken along the central axis O of the ink supply port 81.

Specifically, the region where the first ink absorber 10A is disposed has a large width (diameter) in and near the surface of the ink absorber 10, that is, at a shallow position, and the region where the first ink absorber 10A is disposed has a small width (diameter) below this position. In other words, the region where the first ink absorber 10A is disposed includes a first region 101A having a large width (diameter) and a second region 102A disposed nearer to a bottom 91 than the first region 101A and having a smaller width (diameter) than the first region 101A. It is noted that a second ink absorber 10B is disposed around and in close contact with the first region 101A and the second region 102A.

The first region 101A and the second region 102A both have a constant width (diameter) in the direction of the central axis O. The first region 101A does not reach the side walls 92.

According to this configuration, the ink Q permeability in the directions (left and right directions in the figure) intersecting the central axis O can be further improved at a shallow position of the ink absorber storage container 1. Therefore, the ink Q permeates vertically downward after the ink Q permeates throughout the first ink absorber 10A in the first region 101A. The ink Q permeability can thus be improved in view of the entire ink absorber 10.

The region where the first ink absorber 10A (first liquid absorber) is disposed thus has portions having different shapes in the direction of the central axis O of the ink supply port 81 (supply port) as seen in the cross-section taken along the central axis O of the ink supply port 81. According to this configuration, the ink Q permeability in the directions intersecting the depth direction of the ink absorber storage container 1 can be adjusted by setting the shape of the region where the first ink absorber 10A is disposed in the cross-section as described above. As a result, the ink Q permeability can be adjusted in view of the entire ink absorber 10.

Third Embodiment

Figure 7:
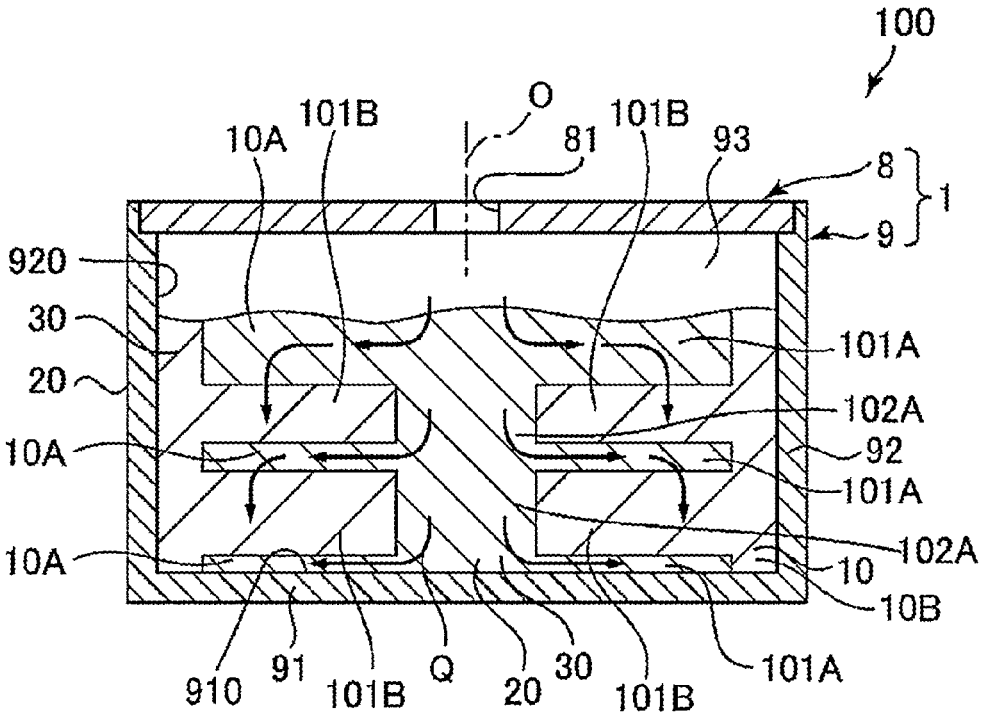
FIG. 7 is a partial vertical cross-sectional view of a third embodiment of the liquid absorbing structure according to the present invention.

FIG. 7 is a partial vertical cross-sectional view of a third embodiment of the liquid absorbing structure according to the present invention.

The third embodiment of the liquid absorbing structure according to the present invention will be described below with reference to this figure. The different points from the above-described embodiment will be mainly described, and the same points will not be described.

This embodiment is the same as the first embodiment except for the shapes of the regions where the first liquid absorber and the second liquid absorber are disposed.

As illustrated in FIG. 7, in this embodiment, first regions 101A alternate with second regions 101B in the direction of the central axis O of the ink supply port 81. The first region 101A, the second region 101B, the first region 101A, the second region 101B, and the first region 101A are disposed sequentially from the ink supply port 81 side.

The advantageous effect described in the second embodiment is obtained by disposing the first region 101A adjacent to the ink supply port 81, that is, on the surface. The ink Q permeability in the directions (left and right directions in the figure) intersecting the central axis O can be further improved near the bottom 91 by disposing the first region 101A in contact with the bottom 91. Furthermore, the ink Q permeability in the directions (left and right directions in the figure) intersecting the central axis O can be further improved in a region in the middle in the depth direction by disposing the first region 101A in the middle in the depth direction. In combination of these effects, the ink Q permeability can be further improved in view of the entire ink absorber 10.

Fourth Embodiment

Figure 8:
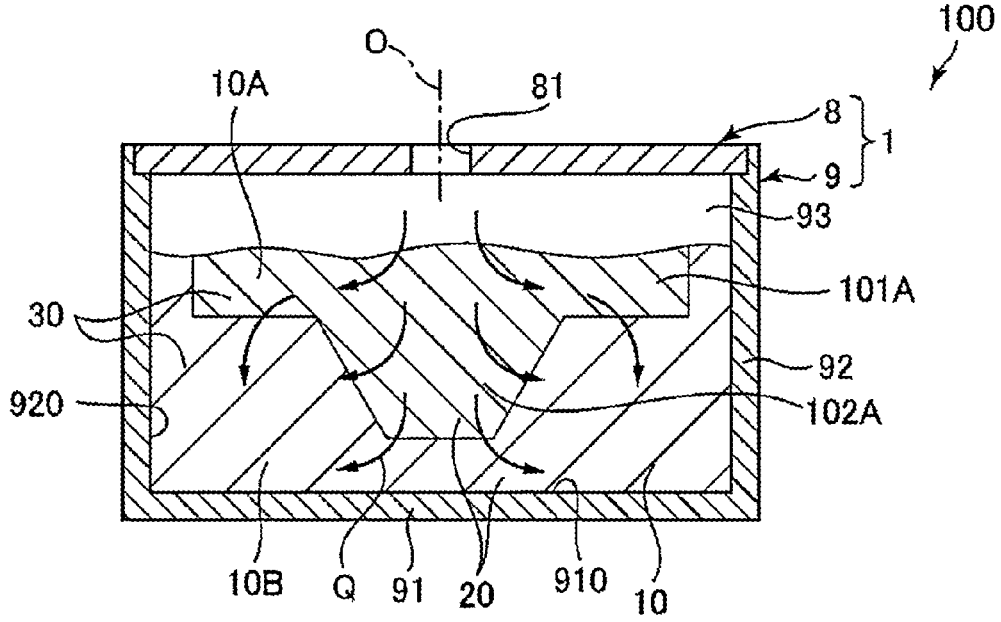
FIG. 8 is a partial vertical cross-sectional view of a fourth embodiment of the liquid absorbing structure according to the present invention.

FIG. 8 is a partial vertical cross-sectional view of a fourth embodiment of the liquid absorbing structure according to the present invention.

The fourth embodiment of the liquid absorbing structure according to the present invention will be described below with reference to this figure. The different points from the above-described embodiment will be mainly described, and the same points will not be described.

This embodiment is the same as the first embodiment except for the shapes of the regions where the first liquid absorber and the second liquid absorber are disposed.

As illustrated in FIG. 8, the width (diameter) of the second region 102A gradually decreases away from the ink supply port 81 in this embodiment. According to this configuration, the permeability of the first ink absorber 10A in the directions intersecting the depth direction of the ink absorber storage container 1 gradually decreases with increasing depth. This configuration can further improve the permeability in the depth direction.

In this embodiment, the second region 102A does not reach the bottom 91. In other words, the second ink absorber 10B is in contact with the bottom 91. This configuration can prevent the ink Q from accumulating near the bottom 91.

Fifth Embodiment

Figure 9:
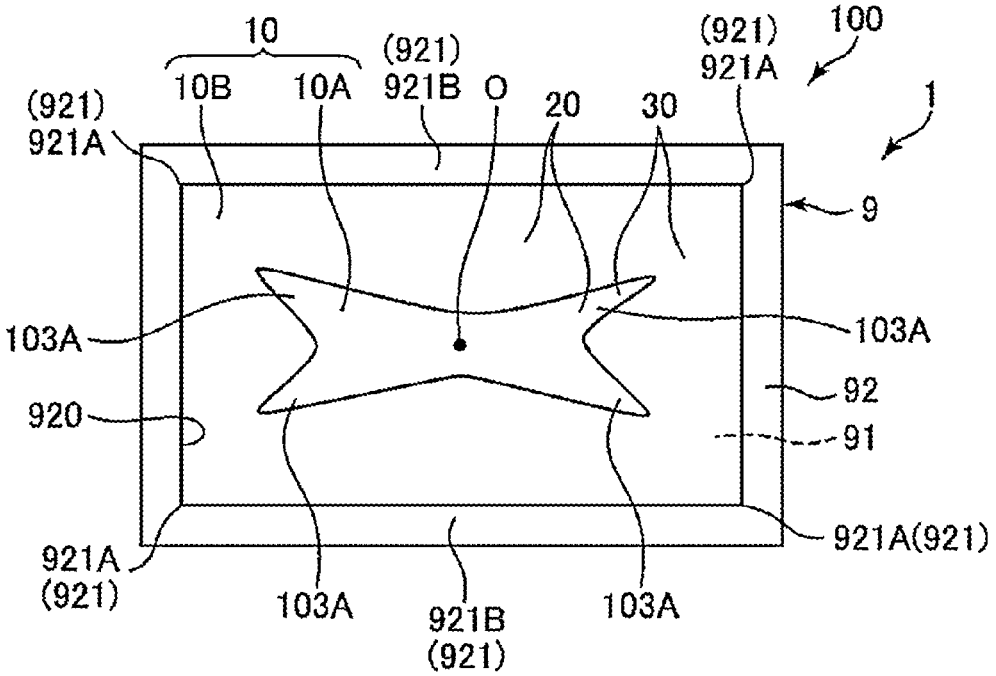
FIG. 9 is a view of the inside of a fifth embodiment of the liquid absorbing structure according to the present invention as seen from the supply port.

FIG. 9 is a view of the inside of a fifth embodiment of the liquid absorbing structure according to the present invention as seen from the supply port.

The fifth embodiment of the liquid absorbing structure according to the present invention will be described below with reference to this figure. The different points from the above-described embodiment will be mainly described, and the same points will not be described.

This embodiment is the same as the first embodiment except for the shapes of the regions where the first liquid absorber and the second liquid absorber are disposed.

As illustrated in FIG. 9, inner side faces 921 of the ink absorber storage container 1 each have a distant portion 921A distant from the central axis O of the ink supply port 81 and a close portion 921B close to the central axis O. The close portion 921B is a portion located at the shortest distance from the central axis O, and the other portion is the distant portion 921A.

The region where a first ink absorber 10A (first liquid absorber) is disposed has protrusions 103A (portions) protruding toward the distant portions 921A. In the illustrated structure, the protrusions 103A protrude toward four corner portions being the distant portions 921A. According to this configuration, the ink Q can more assuredly permeate the second ink absorber 10B located near the distant portions 921B (corner portions).

Sixth Embodiment

Figure 10:
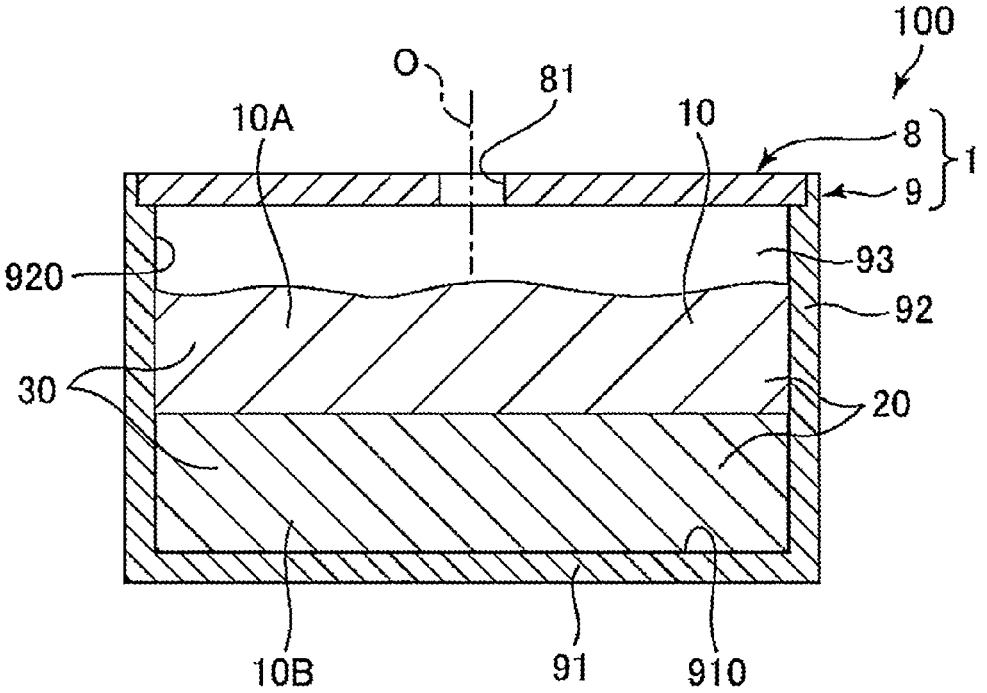
FIG. 10 is a partial vertical cross-sectional view of a sixth embodiment of the liquid absorbing structure according to the present invention.

FIG. 10 is a partial vertical cross-sectional view of a sixth embodiment of the liquid absorbing structure according to the present invention.

The sixth embodiment of the liquid absorbing structure according to the present invention will be described below with reference to this figure. The different points from the above-described embodiment will be mainly described, and the same points will not be described.

This embodiment is the same as the first embodiment except for the shapes of the regions where the first liquid absorber and the second liquid absorber are disposed.

As illustrated in FIG. 10, in this embodiment, as seen in the cross-section taken along the central axis O of the ink supply port 81 (supply port), a first ink absorber 10A (first liquid absorber) is disposed (on the shallow side) proximal to the ink supply port 81 (supply port), and a second ink absorber 10B (second liquid absorber) is disposed (on the deep side) distal to the ink supply port 81 (supply port).

In other words, the second ink absorber 10B and the first ink absorber 10A are sequentially stacked from below. According to this configuration, the ink Q can readily permeate in the depth direction of the ink absorber storage container 1 and the ink Q can more effectively permeate the entire ink absorber 10.

Seventh Embodiment

Figure 11:
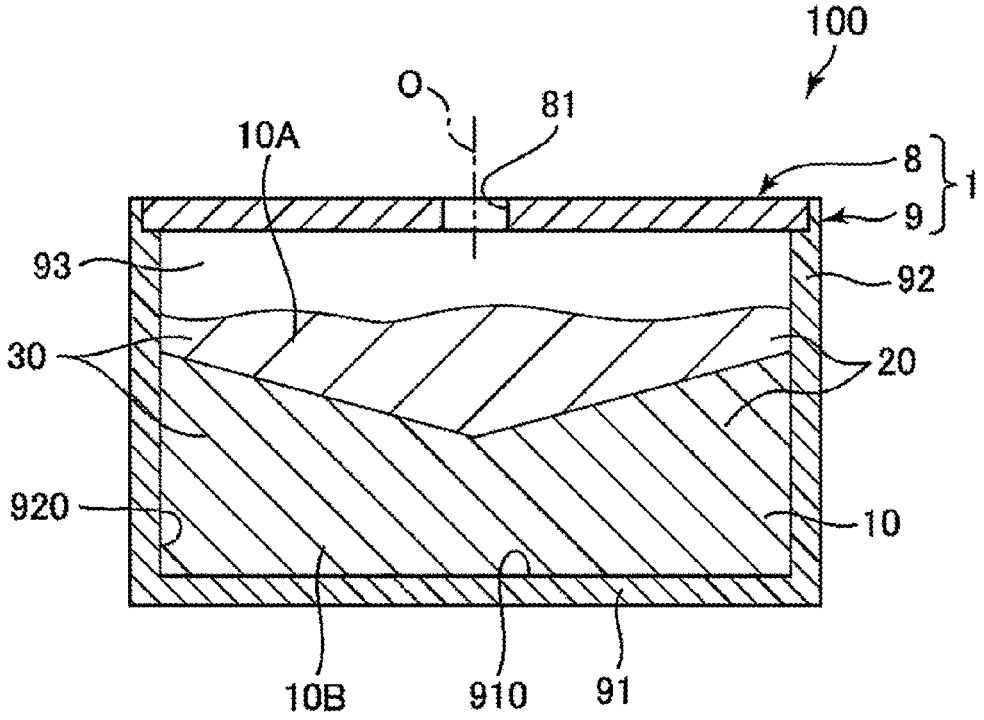
FIG. 11 is a partial vertical cross-sectional view of a seventh embodiment of the liquid absorbing structure according to the present invention.

FIG. 11 is a partial vertical cross-sectional view of a seventh embodiment of the liquid absorbing structure according to the present invention.

The seventh embodiment of the liquid absorbing structure according to the present invention will be described below with reference to this figure. The different points from the above-described embodiment will be mainly described, and the same points will not be described.

This embodiment is the same as the sixth embodiment except for the shapes of the regions where the first liquid absorber and the second liquid absorber are disposed.

As illustrated in FIG. 11, in this embodiment, the interface (boundary surface) between a first ink absorber 10A and a second ink absorber 10B protrudes downward as seen in the cross-section taken along the central axis O of the ink supply port 81. The amount of protrusion is the largest at the central axis O, and the amount of protrusion decreases away from the central axis O. According to this configuration, the ink Q can readily permeate in the depth direction of the ink absorber storage container 1 and the ink Q can more effectively permeate the entire ink absorber 10.

The liquid absorbing structure of the present invention may be a combination of any two or more of the configurations (features) of the embodiments.

In the embodiments, the ink absorber 10 includes the fiber 20 and the water-absorbent resin 30 attached to (carried on) the fiber 20. However, the water-absorbent resin 30 is not necessarily carried on the fiber 20.

REFERENCE SIGNS LIST

Ink absorber storage container, 10 Ink absorber, 10A First ink absorber, 10B Second ink absorber, 101A First region, 101B Second region, 102A Second region, 103A Protrusion, 100 Liquid absorbing structure, 200 Printing apparatus, 201 Ink ejecting head, 201*a* Nozzle, 202 Capping unit, 203 Tube, 203*a* Discharge port, 204 Roller pump, 204*a* Roller unit, 204*b* Holding unit, 20 Fiber, 30 Water-absorbent resin, 8 Lid body, 81 Ink supply port, 9 Container body, 91 Bottom, 910 Bottom face, 92 Side wall, 920 Inner side face, 921 Inner side face, 921A Portion, 93 Storage space, 94 Upper opening, 95 Void, O Central axis, Q Ink

The invention claimed is:

1. A liquid absorbing structure comprising:

a liquid absorber including a first liquid absorber and a second liquid absorber each of which has a fiber and a water-absorbent resin that is configured to absorb liquid; and a container having a supply port through which the liquid is supplied and a storage space in which the liquid absorber is stored, the first liquid absorber having a density of the water-absorbent resin that is different from a density of the water-absorbent resin of the second liquid absorber, and the first liquid absorber and the second liquid absorber being disposed at different positions in the container, in plan view as seen from the supply port, the first liquid absorber being disposed at a position so as to overlap the supply port, and the second liquid absorber being disposed around the first liquid absorber.

2. The liquid absorbing structure according to claim 1, wherein the first liquid absorber is disposed at a position such that the liquid supplied through the supply port first comes into contact with the first liquid absorber, the second liquid absorber is disposed in contact with the first liquid absorber, and the density of the water-absorbent resin of the first liquid absorber is lower than the density of the water-absorbent resin of the second liquid absorber.

3. The liquid absorbing structure according to claim 2, wherein a ratio B1/B2 is 0 or more and 0.9 or less where B1 represents the density of the water-absorbent resin in the first liquid absorber and B2 represents the density of the water-absorbent resin in the second liquid absorber.

4. The liquid absorbing structure according to claim 1, wherein, as seen in a cross-section taken along a central axis of the supply port, a region where the first liquid absorber is disposed has portions having different shapes in a direction of the central axis of the supply port.

5. The liquid absorbing structure according to claim 1, wherein the container has a bottom face and an inner side face that define the storage space, and the first liquid absorber is in contact with the bottom face of the container.

6. The liquid absorbing structure according to claim 1, wherein the container has a bottom face and inner side faces that define the storage space, the inner side faces each have a distant portion distant from a central axis of the supply port and a close portion close to the central axis, and a region where the first liquid absorber is disposed has portions protruding toward the distant portions.

7. The liquid absorbing structure according to claim 1, wherein, as seen in a cross-section taken along a central axis of the supply port, the first liquid absorber is disposed proximal to the supply port, and the second liquid absorber is disposed distal to the supply port.

8. A liquid droplet ejecting apparatus comprising a collecting unit that collects waste ink, wherein the liquid absorbing structure according to claim 1 is installed in the collecting unit.

9. The liquid absorbing structure according to claim 1, wherein the first liquid absorber further has a density of the fiber that is different from a density of the fiber of the second liquid absorber.

10. The liquid absorbing structure according to claim 9, wherein the first liquid absorber is disposed at a position such that the liquid supplied through the supply port first comes into contact with the first liquid absorber, the second liquid absorber is disposed in contact with the first liquid absorber, and the density of the fiber of the first liquid absorber is lower than the density of the fiber of the second liquid absorber.

11. The liquid absorbing structure according to claim 10, wherein a ratio A1/A2 is 0.1 or more and 0.9 or less where A1 represents the density of the fiber in the first liquid absorber and A2 represents the density of the fiber in the second liquid absorber.

12. The liquid absorbing structure according to claim 1, wherein the container includes a container body having the storage space, and a lid body having the supply port, and detachably attached to a top portion of the container body so as to be spaced apart from the liquid absorber, and the lid body has water vapor permeability.

* * * * *